US005996146A

United States Patent [19]

McPherson

[11] Patent Number: 5,996,146

[45] Date of Patent: Dec. 7, 1999

[54] ZIPPERLESS SLEEPING BAG

[76] Inventor: Mathew A. McPherson, R.R. 1, Norwalk, Wis. 54648

[21] Appl. No.: 09/003,969

[22] Filed: Jan. 7, 1998

[51] Int. Cl.[6] ..... A47G 9/08

[52] U.S. Cl. ..... 5/413 R

[58] Field of Search ..... 5/413 R, 413 AM, 5/494; 2/69, 69.5

[56] References Cited

U.S. PATENT DOCUMENTS

| | | | |
|---|---|---|---|
| 1,284,046 | 11/1918 | Blocksom | 5/413 |
| 1,602,941 | 6/1926 | Rosman . | |
| 3,988,791 | 11/1976 | Simon | 5/413 R |
| 4,534,065 | 8/1985 | Comfort | 2/69.5 |
| 4,579,753 | 4/1986 | Gjendmesjo | 5/413 R |
| 5,033,135 | 7/1991 | Creek | 5/413 |
| 5,046,204 | 9/1991 | Mohler | 5/413 |
| 5,093,947 | 3/1992 | Henegar et al. | 5/413 |
| 5,193,235 | 3/1993 | Kircher | 5/413 |
| 5,640,725 | 6/1997 | Ando et al. | 5/413 AM |

OTHER PUBLICATIONS

L.L. Bean, Summer Sporting 1997 Catalog, p.21.

*Primary Examiner*—Alexander Grosz
*Attorney, Agent, or Firm*—Vidas, Arrett & Steinkraus, P.A.

[57] ABSTRACT

A zipperless sleeping bag with a foldable flap for extra warmth and a method for making the same is provided. The sleeping bag consists of a substrate comprising three portions, a body portion, a first cover portion and a second cover portion each of which is characterized by a longitudinal and lateral length, the three portions having substantially equally lateral lengths. The first cover portion is folded over the body portion and fastened thereto along the bottom and at least a part of the side edge of the portions. At least a part of the second cover portion is folded over the first cover portion and body portion. The second cover portion serves either as a foldable flap which can be folded over the first cover portion to provide extra warmth or as the primary cover in more temperate sleeping conditions.

27 Claims, 4 Drawing Sheets

ZIPPERLESS SLEEPING BAG

BACKGROUND OF THE INVENTION

The present invention relates to a zipperless sleeping bag for use indoors or outdoors.

Conventional sleeping bags for camping purposes are composed of a lower cover and an upper cover, the upper cover fastened to the lower cover along the periphery of the upper cover and the periphery of the lower cover so as to form a pocket. U.S. Pat. No. 1,284,046 to Blocksom describes one such sleeping bag.

More recently blankets, comforters and sleeping bags have been disclosed in which first and optionally second side portions may be folded over a central body portion to envelope at least a portion of a human body. U.S. Pat. No. 4,534,065 to Comfort, U.S. Pat. No. 5,093,947 to Henegar et al. and U.S. Pat. No. 5,640,725 to Ando et al. are among many such disclosures.

Unfortunately, the side portions may slide off of the central portion as a result of movement on the part of a person resting within such blankets, comforters or sleeping bags. Even where fasteners are provided to prevent such an occurrence, it can be awkward for the resident of the bag to fasten the side portions, in particular at the bottom of the bag, without exiting the bag.

It is a goal of the present invention to provide a zipperless sleeping bag with foldable side portions which are at least partially affixed to the central body portion so as to form a pouch in which a person may rest. The inventive zipperless sleeping bag eliminates the need of the individual residing therein to fasten the side portions.

SUMMARY OF THE INVENTION

The present invention provides a zipperless sleeping bag comprising a sleeping bag substrate folded so as to form a pouch for a body between a body portion of the substrate and a first covering portion of the substrate. The substrate further comprises a second covering portion which is at least partially folded over the body and first covering portions and fixedly attached to the bottom portion of the body portion and a least a part of the side of the body portion so as to form a foldable flap for further comfort.

Additionally, a method of making the same is provided comprising the steps of folding at least a portion of the first covering portion over the body portion so that at least a portion of the outer edge of the first covering portion rests on the second edge of the body portion and so that the bottom edge of the first covering portion rests on the bottom edge of the body portion, at least partially folding the second covering portion over the first covering portion so that at least a portion of the outer edge of the second covering portion rests over the first edge of the body portion and so that the bottom edge of the second covering portion rests over the bottom edge of the body portion, fixedly attaching a continuous region of the bottom edge and a portion of the outer edge of the first covering portion to a continuous region of the bottom edge and a portion of the second edge of the body portion and fixedly attaching a continuous region of the bottom edge and outer edge of the second covering portion to a continuous region of the bottom edge and first edge of the body portion, so that a pouch is formed, in which a body may lie, between the body portion and the first covering portion, and the second covering portion serves as a movable flap for additional comfort.

DETAILED DESCRIPTION OF THE INVENTION

The inventive zipperless sleeping bag comprises a sleeping bag substrate. The sleeping bag substrate has a body portion having a top side, bottom side and first and second edges extending between the top and bottom sides. The substrate further has a first covering portion having a top side, bottom side and inner and outer edges, the inner edge of the first covering attached to the first edge of the body portion. The substrate further has a second covering portion having a top side, bottom side and inner and outer edges, the inner edge of the second covering attached to the second edge of the body portion. The bottom side of the first covering is fixedly attached to the bottom side of the body portion. Further, at least a portion of the outer edge of the first covering extending from the bottom side of the first covering is fixedly attached to the second edge of the body portion in a side region of attachment along a part of the second edge extending from the bottom side of the body portion toward the top side of the body portion so as to form a pouch for sleeping. The side region of attachment preferably extends from ⅕ to ½ of the length of the outer edge of the first covering. The second covering may be folded over the first covering for extra warmth.

Figure 1:
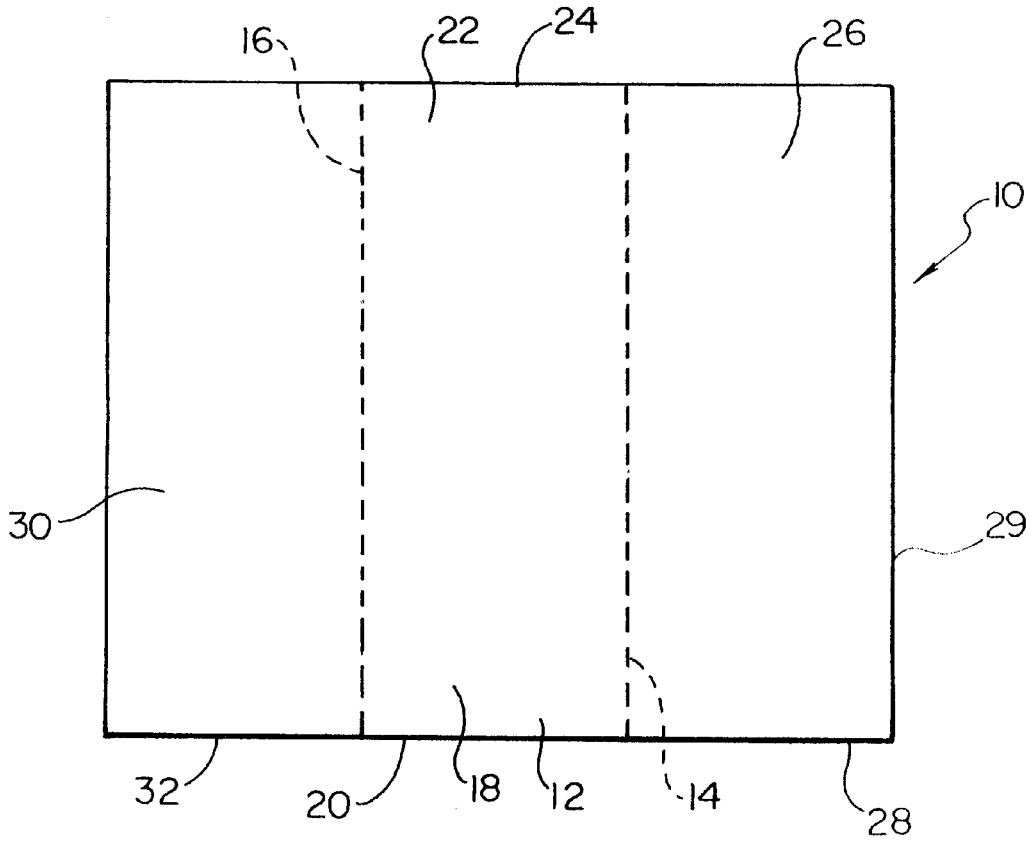
FIG. 1 is a plan view of a sleeping bag substrate used in the present invention.

Referring to FIG. 1, the zipperless sleeping bag of the present invention is formed of a sleeping bag substrate, generally designated by the reference numeral 10. The sleeping bag substrate consists of a body portion 12 having a first edge 14, a second edge 16 opposite the first edge 14, a foot portion 18 having a bottom edge 20 and a head portion 22 having a top edge 24 opposite the bottom edge 20. As seen in FIG. 1, sleeping bag substrate 10 further consists of a first covering portion 26 extending from first edge 14 of body portion 12. First covering portion 26 has a first covering bottom edge 28 adjacent to bottom edge 20 of foot portion 18 and a first covering outer edge 29. As is further seen in FIG. 1, sleeping bag substrate 10 further consists of a second covering portion 30 extending from second edge 16 of body portion 12. Second covering portion 30 has a second covering bottom edge 32 adjacent to bottom edge 20 of foot portion 18. The lengths of body portion 12 bottom edge 20, first covering portion 26 bottom edge 28 and second covering portion 30 bottom edge 32 are substantially equal.

Figure 2:
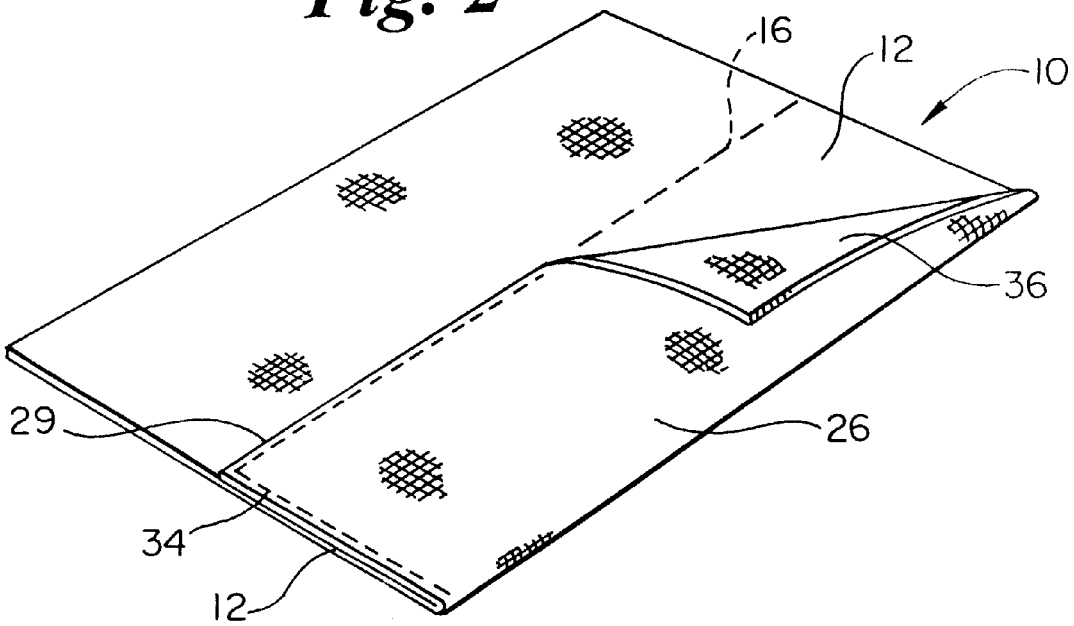
FIG. 2 is a schematic view showing the sleeping bag substrate prior to folding at least a part of the second covering portion over the first covering portion and body and the manner in which the fold is made in forming the inventive zipperless sleeping bag.

As best seen in FIG. 2, first covering portion 26 of sleeping bag substrate 10 is folded over body portion 12 and fixedly attached to body portion 12 via stitching in a region of attachment 34. Region of attachment 34 extends along the length of first covering bottom edge 20 and up along at least a part of first covering outer edge 29 so as to attach first covering bottom edge 28 to bottom edge 20 of foot portion 18 and to further affix at least portion of first covering outer edge 29 to second edge 16. Preferably, region of attachment 34 will extend from about ⅕ to about ½ of the way up second edge 16. Most preferably, region of attachment 34 will extend about ¼ of the way up second edge 16 The region between body portion 12 and first covering portion 26 forms a first sleeping pouch in which a body may lie. This first sleeping pouch is the preferred pouch for sleeping in cold weather conditions. Note, triangular flap 36 is shown for illustrative purposes only, to better depict the position of first covering portion 26 relative to body portion 12 and is not an integral feature of the invention.

Figure 3:
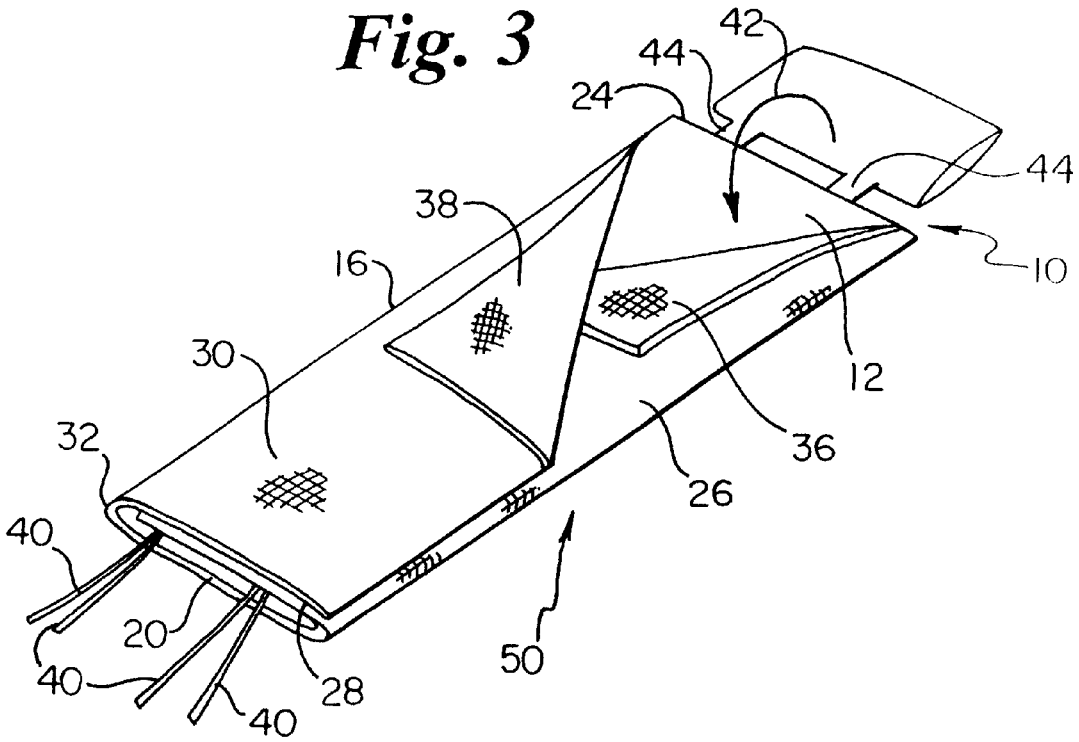
FIG. 3 is a schematic view of one embodiment of the inventive zipperless sleeping bag.

After the first sleeping pouch is formed, at least a part of second covering portion 30 may be folded over first covering portion 26 and body portion 12 such that bottom edge 32 of second covering portion 30 rests over bottom edge 28 of first covering portion 26 as illustrated in FIG. 3. This covering provides for extra warmth in cold weather sleeping conditions. The region between second covering portion 30 and first covering portion 26 forms a second sleeping pouch for more temperate sleeping conditions.

The zipperless sleeping bag optionally further includes a pillow pouch for holding a pillow. In a preferred embodiment, pillow pouch 42 is attached to top edge 24 of body portion 12 via straps 44 emanating from pillow pouch 42. In use, pillow pouch 42 is folded over body portion 12 so as to rest on body portion 12 and a pillow inserted therein. Of course, the pillow pouch may be attached directly to the top edge of the body portion without using straps. The pillow pouch may be permanently attached to the body portion or may be removably attached thereto (for example by VELCRO or a hook and loop fastener straps) to allow for easy removal of the pillow pouch for cleaning or other purposes. Alternatively, although not depicted, the pillow pouch may be formed as an integral part of body portion 12. The pillow pouch so formed at the head portion may include an entry way located from top edge 24 of body portion 12.

Figure 4:
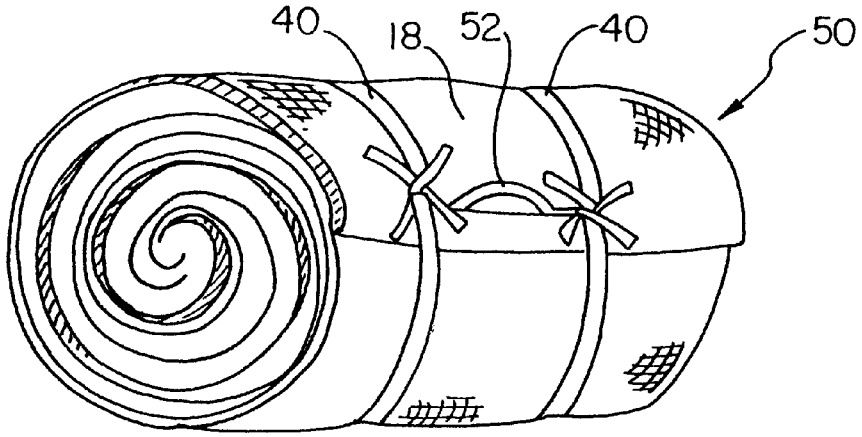
FIG. 4 illustrates the zipperless sleeping bag when rolled and secure for transport.

Optionally, the zipperless sleeping bag, shown generally at 50 in FIG. 3, may include a plurality of tie straps 40 attached externally or sewn, during construction, into the bottom edges 20, 28 or 32 or the top edges of zipperless sleeping bag 50. Tie straps 40 are positioned as shown in FIG. 4 to secure the rolled up sleeping bag 50. Zipperless sleeping bag 50 may further comprise a carrying handle 52 sewed thereto. The carrying handle 52 is preferably formed of a soft, pliable yet strong material affixed to the back of the bottom portion 18 of the body portion.

Figure 5:
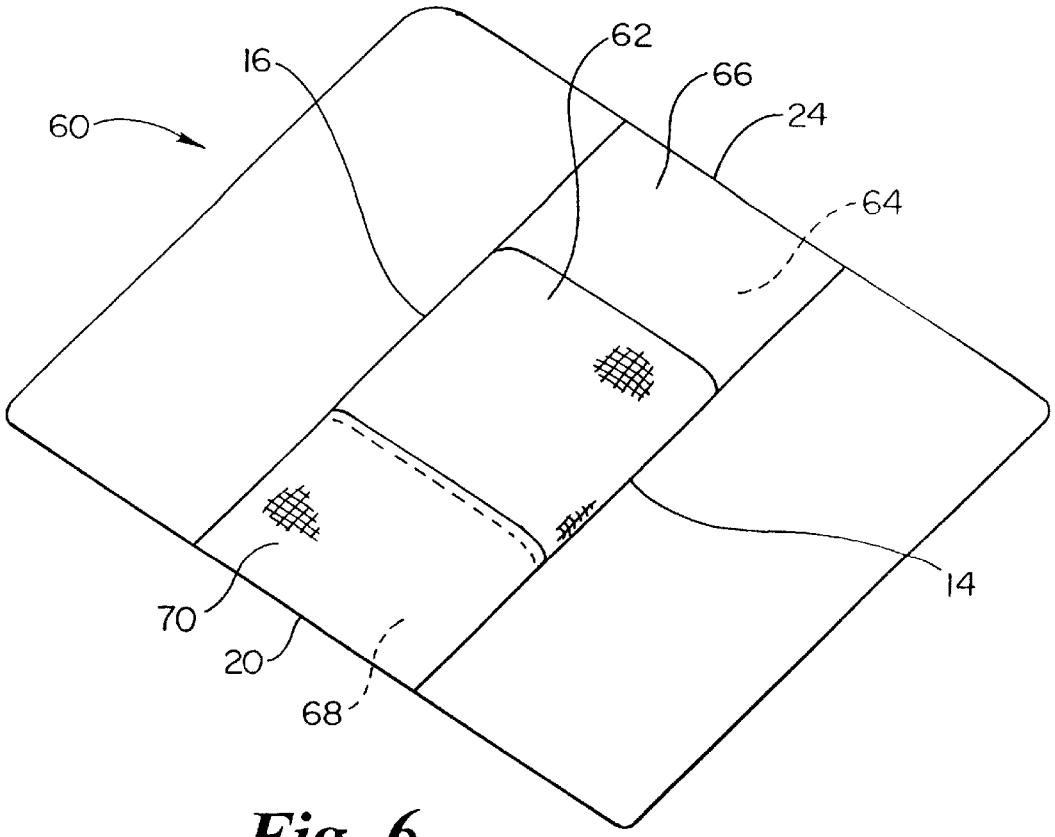
FIG. 5 is a plan view of the backside of the sleeping bag substrate of the present invention.

The zipperless sleeping bag also may have one or more pockets in the backside of the body portion to hold a pad therein. The backside of the sleeping bag is shown generally at 60 in FIG. 5. As depicted in FIG. 5, the backside 62 of body portion 12 has a first pocket 64 formed therein by fixedly attaching a piece of material 66 to backside 62 along top edge 24, a portion of first edge 14 and a portion of second edge 16 of backside 62 of body portion 12. Backside 62 further has a second pocket 68 formed therein by fixedly attaching a piece of material 70 to backside 62 along bottom edge 20, a portion of first edge 14 and a portion of second edge 16 of backside 62 of body portion 12 as depicted in FIG. 5. A pad, such as a 2 inch thick foam pad spanning approximately the length of the inventive bag, an air mattress or other device or material extending approximately from the head of the inventive bag to the foot may be secured to the backside of the sleeping bag by inserting the ends into the pockets thereby cushioning the user of the zipperless sleeping bag from any abnormalities in the surface upon which the inventive sleeping bag rests. A similar design employing only one pocket is also suitable.

Figure 6:
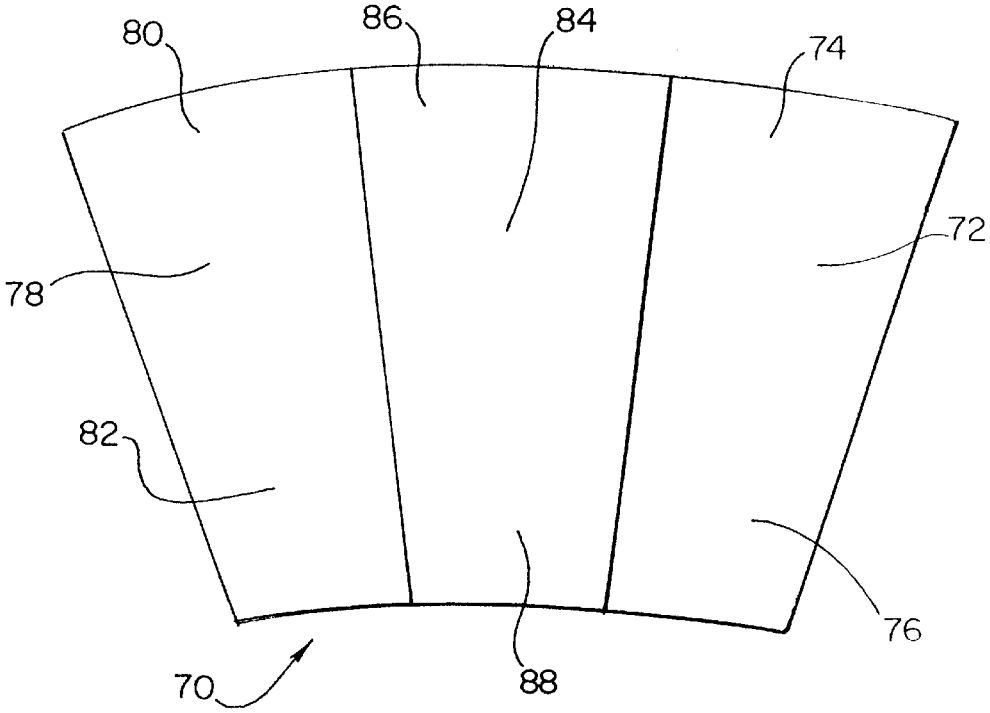
FIG. 6 is a plan view of another sleeping bag substrate for use in the present application.
Figure 7:
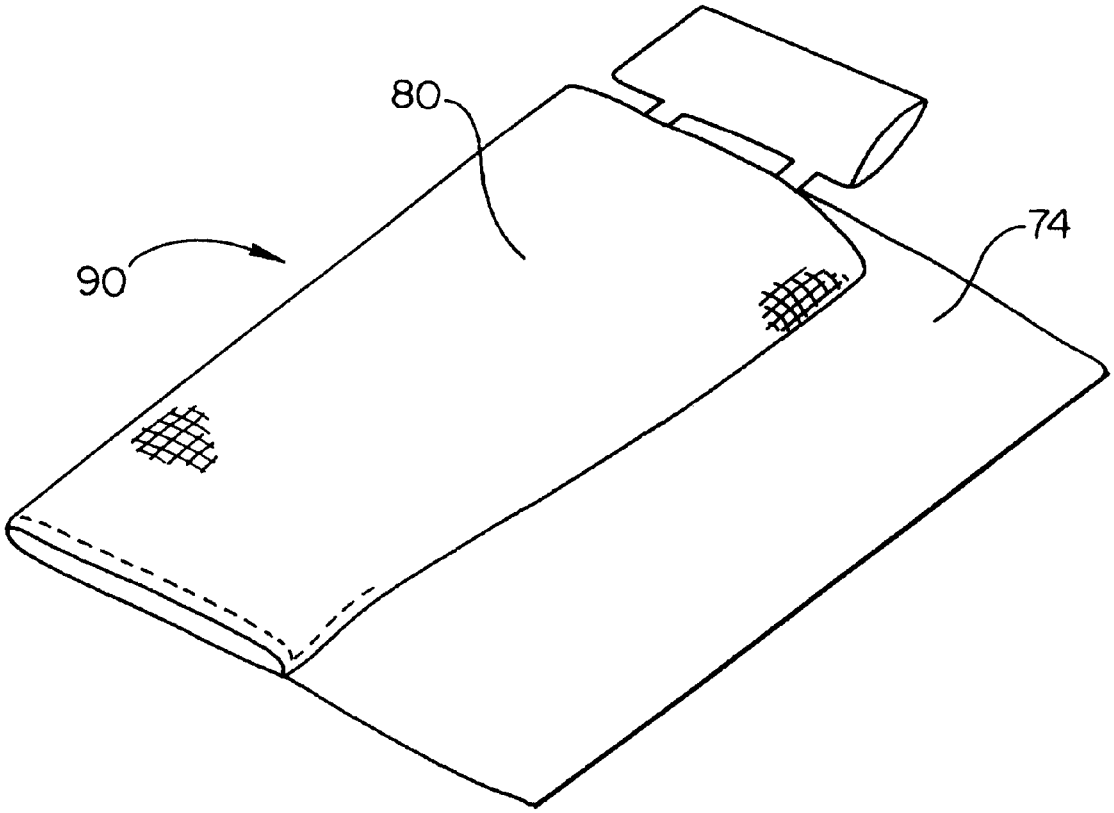
FIG. 7 is a schematic view showing an embodiment of the sleeping bag with the first covering portion exposed.

Preferably, the sleeping bag substrate will be symmetric about the longitudinal axis of the substrate. Non-symetric substrate shapes, may, however, be used as well. The body portion and first and second covering portions of the sleeping bag substrate may be square or rectangular or trapezoidal and tapered from the head portion to the foot portion or any other suitable shape. Where tapered, the taper may be straight or curved. Preferably, as shown in FIG. 6, the first covering portion 72 of the substrate shown generally at 70 will be tapered inward from the first covering head portion 74 to the first covering foot portion 76, the second covering portion 78 will be tapered inward from the second covering head portion 80 to the second covering foot portion 82 and body portion 84 will be tapered inward from head portion 86 to foot portion 88. A sleeping bag formed of this substrate is shown generally at 90 in FIG. 7. The wider head portion of the first and second covering portions provides additional covers with which to cover the restless sleeper.

Of course, it should be noted that combinations of shapes of body, first and second covering portions other than those depicted in the Figures are contemplated as well. Thus, for example, a rectangular body portion may be used in conjunction with trapezoidal first and second covering portions. Further, body and/or first and/or second covering portions with rounded sides may be used.

While the sleeping bag substrate is preferably formed of a single piece of material, or two pieces of material with insulation in between, it may also be formed of several pieces of material fixedly attached to one another. In one embodiment, the first covering portion is made of a first piece of material, the second covering portion is made of a second piece of material, and the body portion is made of a third piece of material. Optionally the first and/or second and/or third pieces of material may be made of the same type of material or of different types of materials.

Any suitable material may be used for the sleeping bag substrate including blanket material, bunting, quilting and combinations thereof. In one embodiment, body portion 12 will be formed of a soft material on the side on which the body rests. Soft materials include, but are not intended to be limited to, imitation furs. While first and second covering portions 26 and 30 may be formed of any suitable material, they are preferably formed of an insulating material for insuring that the person remains warm in the zipperless sleeping bag. The sleeping bag substrate may also be formed a suitable material formed of a plurality of layers enclosing one or more layers of batting, such as polyester, down feathers or other insulating material. The outer surfaces of the sleeping bag substrate, that is, the surfaces that are exposed to the elements may be formed of a waterproof substance such as GoreTex or treated with a waterproofing substance.

In one preferred embodiment, the sleeping bag substrate backside is made from Primaloft PL1 material or Primaloft PL2 material both of which are waterproof. The frontside is made from Primaloft PL Light material. Primaloft PL1, PL2 and PL Light materials are produced by Albany International Corporation of Albany, N.Y.

For the purposes of the present invention, fixedly attached refers to sewing, stitching or adhesively bonding. Any suitable sewing or stitching pattern may be employed to fixedly attach the relevant sections of the zipperless sleeping bag to one another. Any adhesives suitable for use with the above mentioned materials may be employed to fixedly attach the relevant sections of the zipperless sleeping bag. Where the portions are fixedly attached by sewing or stitching, the first covering portion may optionally be affixed to the body portion with the same stitching fixing the second covering portion to the first covering portion and body portion.

With the Primaloft PL1 and PL Light materials, the user of the inventive sleeping bag can rest in the second sleeping pouch at temperatures as low as about 50° F. For temperatures between about 50° F. and 0° F., the user of the sleeping bag can rest in the first sleeping pocket and pull the second covering portion of the first covering portion for additional warmth. Of course, the inventive sleeping bags may be used in more extreme conditions if appropriate insulating materials are used.

The present invention also contemplates a method of making the inventive sleeping bag. The method comprises a first step of providing a substrate having first and second covering portions and a body portion and folding at least a portion of the first covering portion over the body portion so that at least a portion of the outer edge of the first covering portion rests on the second edge of the body portion and so that the bottom edge of the first covering portion rests on the bottom edge of the body portion. The method further comprises at least partially folding the second covering portion over the first covering portion so that at least a portion of the outer edge of the second covering portion rests over the first edge of the body portion and so that the bottom edge of the second covering portion rests over the bottom edge of the body portion. The method comprises a third step of fixedly attaching a continuous region of the bottom edge and a portion of the outer edge of the first covering portion to a continuous region of the bottom edge and a portion of the second edge of the body portion. Finally, the fourth step consists of fixedly attaching a continuous region of the bottom edge and outer edge of the second covering portion to a continuous region of the bottom edge and first edge of the body portion. Optionally, the third and fourth steps may be combined into one step. As a result of the method, a pouch is formed, in which a body may lie, between the body portion and the first covering portion, and the second covering portion serves as a movable flap for additional comfort.

The present invention also contemplates a zipperless sleeping bag having a sleeping pouch and a cover for use in cold weather. The bag comprises an upper portion, a lower portion and a cover. Each of the upper and lower portions and cover have a top edge, a bottom edge, and first and second edges extending between the top and bottom edges. The first edge of the upper portion is fixedly attached to the first edge of the lower portion, and the bottom edge of the upper portion is fixedly attached to the bottom edge of the lower portion. Further, a part of the second edge of the upper portion extending from the bottom edge thereof is fixedly attached to the second edge of the lower portion in a region of attachment so as to form a sleeping pouch. Finally, the cover extends from the second edge of the lower portion.

Preferably, the region of attachment ranges from ⅕ to ½ the length of the second edge of the upper portion. Also preferably, the first and second edges of the upper portion, lower portion and cover are tapered inwards from the top edges to the bottom edges. In a preferred embodiment, the upper and lower portions and cover are formed of an integral substrate.

The above Examples and disclosure are intended to be illustrative and not exhaustive. These examples and description will suggest many variations and alternatives to one of ordinary skill in this art. All these alternatives and variations are intended to be included within the scope of the attached claims. Those familiar with the art may recognize other equivalents to the specific embodiments described herein which equivalents are also intended to be encompassed by the claims attached hereto.

What is claimed is as follows:

1. A zipperless sleeping bag comprising a sleeping bag substrate, the sleeping bag substrate having:

a body portion having a top side, bottom side and first and second edges extending between the top and bottom sides;

a first covering portion having a top side, bottom side and inner and outer edges, the inner edge of the first covering attached to the first edge of the body portion; and a second covering portion having a top side, bottom side and inner and outer edges, the inner edge of the second covering attached to the second edge of the body portion, wherein the bottom side of the first covering is fixedly attached to the bottom side of the body portion and wherein at least a portion of the outer edge of the first covering extending from the bottom side of the first covering is fixedly attached to the second edge of the body portion in a side region of attachment along a part of the second edge extending from the bottom side of the body portion toward the top side of the body portion.

2. The zipperless sleeping bag of claim 1 wherein the first covering portion has a bottom edge, the second covering portion has a bottom edge, the body portion has a bottom edge, the bottom side of the first covering is fixedly attached to the bottom side of the body portion along the bottom edge of the first covering portion, and the side region of attachment extends along the outer edge from the bottom edge of the first covering to about ⅕ to about ½ of the length of the outer edge of the first covering.

3. The zipperless sleeping bag of claim 2, the first covering having a front and a back, and the body portion having a front and a back, wherein the first covering is fixedely attached to the body portion such that at least a part of the front of the first covering is fixedly attached to at least a part of the front of the body portion.

4. The zipperless sleeping bag of claim 3 wherein a) the inner and outer edges of the first covering are tapered inward from the top side to the bottom side;

b) the inner and outer edges of the second covering are tapered inward from the top side to the bottom side; and c) the first and second edges of the body portion are tapered inward from the top side to the bottom side.

5. The zipperless sleeping bag of claim 3, wherein the first covering, second covering and body portion are each substantially rectangular.

6. The zipperless sleeping bag of claim 3, wherein the substrate is symmetric with respect to a longitudinal axis extending from the bottom edge to the top edge of the body portion.

7. The zipperless sleeping bag of claim 6 wherein the second covering is at least partially folded over the first covering.

8. The zipperless sleeping bag of claim 6 further comprising a pillow pouch for removably containing a pillow.

9. The zipperless sleeping bag of claim 8 wherein the pillow pouch is within the top side of the body portion.

10. The zipperless sleeping bag of claim 8 wherein the pillow pouch is attached to the body portion along a part of the top side.

11. The zipperless sleeping bag of claim 10 wherein the pillow pouch is removably attached to the body.

12. The zipperless sleeping bag of claim 6 further comprising a carrying means fixedly attached thereto.

13. The zipperless sleeping bag of claim 3 wherein the first covering is fixedly attached to the body portion by stitching therethrough.

14. The zipperless sleeping bag of claim 3 wherein the length of the bottom edges of first covering, second covering and body portion are substantially equal.

15. The zipperless sleeping bag of claim 14 wherein the first and second covering are substantially the same size.

16. The zipperless sleeping bag of claim 3, the body portion having a top edge, the first covering having a top edge and the second covering having a top edge, wherein the length of the top edges of the first and second coverings is greater than the length of the top edge of the body portion.

17. The zipperless sleeping bag of claim 3 wherein the substrate is integrally formed.

18. The zipperless sleeping bag of claim 3 wherein the substrate is formed of a material selected from the group of materials consisting of blanket material, bunting, quilting and combinations thereof.

19. The zipperless sleeping bag of claim 3, the back of the sleeping bag resting on a surface when the sleeping bag is in use, wherein the back has one or more pockets therein for securing a pad thereto.

20. The zipperless sleeping bag of claim 16 wherein the backside has two pockets therein, a first pocket in the top side portion of the back and the second pocket in the bottom side of the back, the two pockets arranged so as to secure the pad to the backside of the sleeping bag.

21. The zipperless sleeping bag of claim 3 wherein the substrate is formed of a waterproof material having an insulating layer therein.

22. A method of making a zipperless sleeping bag from a sleeping bag substrate comprising the steps of:

1) providing a substrate having
   - a body portion having a top side, bottom side and bottom edge and first and second edges extending between the top and bottom sides;
   - a first covering portion having a top side, bottom side and bottom edge and inner and outer edges, the inner edge of the first covering attached to the first edge of the body portion; and
   - a second covering portion having a top side, bottom side and bottom edge and inner and outer edges, the inner edge of the second covering attached to the second edge of the body portion;

2) folding at least a part of the first covering over the body portion so that at least a portion of the outer edge of the first covering rests on at least a part of the second edge of the body portion and so that the bottom edge of the first covering rests on the bottom edge of the body portion;

3) fixedly attaching at least part of the bottom edge of the first covering to the bottom edge of the body portion;

4) fixedly attaching a part of the outer edge of the first covering extending from the bottom edge thereof to a part of the second edge of the body portion extending from the bottom edge thereof in a region of attachment so as to form a first sleeping pouch between the body portion and the first covering.

23. The method of claim 22 wherein the region of attachment extends from the bottom edge of the body portion, along the second edge to a distance of from ⅕ to ½ the length of the second edge.

24. The method of claim 22 further including the step of at least partially folding the second covering over the first covering so that at least a portion of the outer edge of the second covering rests over the first edge of the body portion and so that the bottom edge of the second covering rests over the bottom edge of the body portion so as to form a second sleeping pouch between the first cover portion and the second cover portion, the second cover portion further serving as a movable flap for additional comfort.

25. A zipperless sleeping bag comprising a sleeping pouch and a cover for use in cold weather comprising:

a upper portion having a top edge, a bottom edge, and first and second edges extending between the top and bottom edges;

a lower portion having a top edge, a bottom edge, and first and second edges extending between the top and bottom edges, a cover having a top edge, a bottom edge, and first and second edges extending between the top and bottom edges, wherein the first edge of the upper portion is fixedly attached to the first edge of the lower portion, and wherein the bottom edge of the upper portion is fixedly attached to the bottom edge of the lower portion, and wherein a part of the second edge of the upper portion extending from the bottom edge thereof is fixedly attached to the second edge of the lower portion in a region of attachment so as to form a sleeping pouch, and the cover extending from the second edge of the lower portion.

26. The zipperless sleeping bag of claim 25 wherein the region of attachment ranges from ⅕ to ½ the length of the second edge of the upper portion.

27. The zipperless sleeping bag of claim 26 wherein the first and second edges of the upper portion, lower portion and cover are tapered inwards from the top edges to the bottom edges.

* * * * *